US008065753B2

(12) United States Patent
Sørensen et al.

(10) Patent No.: US 8,065,753 B2
(45) Date of Patent: Nov. 29, 2011

(54) GARMENT PROTECTION DEVICE AND METHOD FOR REDUCING THE RISK OF BONE FRACTURE

(75) Inventors: Bettina Balslev Sørensen, Silkeborg (DK); Steve Robinovitch, West Vancouver (CA); Anna Marie Houe Kjærsgaard, Herning (DK)

(73) Assignee: Tytex A/S, Ikast (DK)

( * ) Notice: Subject to any disclaimer, the term of this patent is extended or adjusted under 35 U.S.C. 154(b) by 1017 days.

(21) Appl. No.: 11/794,550

(22) PCT Filed: Dec. 29, 2005

(86) PCT No.: PCT/DK2005/000835

§ 371 (c)(1), (2), (4) Date: Sep. 13, 2007

(87) PCT Pub. No.: WO2006/069582

PCT Pub. Date: Jul. 6, 2006

(65) Prior Publication Data

US 2009/0271918 A1 Nov. 5, 2009

(30) Foreign Application Priority Data

Dec. 29, 2004 (DK) ..... 2004 02020

(51) Int. Cl.
*A41D 13/00* (2006.01)

(52) U.S. Cl. ..... 2/465

(58) Field of Classification Search ..... 2/465, 79, 2/227, 238, 228, 455, 69, 247, 94
See application file for complete search history.

(56) References Cited

U.S. PATENT DOCUMENTS 2,889,830 A 6/1959 Raymond
(Continued)

FOREIGN PATENT DOCUMENTS

AT 405782 11/1999
(Continued)

*Primary Examiner* — Tejash Patel
(74) *Attorney, Agent, or Firm* — Edwards Wildman Palmer LLP; Peter F. Corless; Lisa Swiszcz

(57) ABSTRACT

Here is disclosed a garment a device and a method for reducing the risk of bone fracture of a human or animal subject due to impact forces on a vulnerable region having a bone part, e.g. the greater trochanter near the skin surface, there being a soft tissue region proximate to the vulnerable region lacking a bone part near the skin surface. The garment comprises at least one protective device shaped in accordance with anatomical features of the vulnerable region and the soft tissue region so that the impact energy is shunted for the vulnerable region to the soft tissue region, where such energy may be safely dissipated and mounting means for removable mounting the at least one protective device on the subject in a manner permitting the shunting of impact energy from the vulnerable region to the soft tissue region. The protective device is shaped for partly or totally surrounding the vulnerable region and has a thickness establishing a protective free space that will not transfer energy above the vulnerable region and comprises a soft and elastic material having a suitable elasticity and hardness, so that in the case of a fall the impact force will partly compress the device against the soft tissue region and as the elastic material rigidifies during its compression, it will gradually transfer the energy to the surrounding soft tissue, whereby a substantial portion of the impact energy is absorbed and retransmitted to the soft tissue region. The garment provides a lightweight, soft and less bulky protective device which is comfortable for the wearer and which maintain a stable form and which still makes it possible to transmit sufficient impact energy to the soft tissue region surrounding a vulnerable region.

20 Claims, 9 Drawing Sheets

U.S. PATENT DOCUMENTS

| | | | |
|---|---|---|---|
| 3,772,899 | A | 11/1973 | Novi |
| 4,390,024 | A | 6/1983 | Williams |
| 4,641,641 | A | 2/1987 | Strock |
| 5,269,720 | A | 12/1993 | Moretz et al. |
| 5,479,791 | A | 1/1996 | Osborne |
| 5,553,468 | A | 9/1996 | Osborne |
| 5,592,836 | A | 1/1997 | Schuster et al. |
| 5,599,290 | A | 2/1997 | Hayes et al. |
| 5,790,981 | A | 8/1998 | Bzoch |
| 5,873,767 | A | 2/1999 | Pickett |
| 5,946,944 | A | 9/1999 | Osborne |
| 6,083,079 | A | 7/2000 | Pearson |
| 6,125,664 | A | 10/2000 | Browder, Jr. |
| 6,178,784 | B1 | 1/2001 | Marley, Jr. |
| 6,195,809 | B1 | 3/2001 | Garcia |
| 6,287,168 | B1 | 9/2001 | Rabinowicz |
| 6,334,443 | B1 | 1/2002 | Olsen |
| 6,361,398 | B1 | 3/2002 | Knapp |
| 6,645,041 | B2 | 11/2003 | Sorensen |
| 6,854,132 | B1 | 2/2005 | Polzin |
| 6,855,029 | B2 | 2/2005 | Rothman |
| 7,076,809 | B2 | 7/2006 | Rothman |
| 2003/0097860 | A1 | 5/2003 | Sciacca |
| 2003/0135917 | A1 | 7/2003 | Ruane |
| 2003/0186617 | A1 | 10/2003 | Sorensen |
| 2005/0028243 | A1 | 2/2005 | Polzin |

FOREIGN PATENT DOCUMENTS

| | | | |
|---|---|---|---|
| GB | 2349798 | A | 11/2000 |
| JP | 8-503526 | | 4/1996 |
| JP | 2002-544405 | | 12/2002 |
| WO | WO94/12066 | | 6/1994 |
| WO | WO 98/44817 | | 10/1998 |
| WO | WO00/69293 | | 11/2000 |
| WO | WO 01/68964 | | 9/2001 |
| WO | WO03/022085 | | 3/2003 |
| WO | WO 03/022085 | A2 | 3/2003 |
| WO | WO 03/082033 | | 10/2003 |

GARMENT PROTECTION DEVICE AND METHOD FOR REDUCING THE RISK OF BONE FRACTURE

This application claims the benefit of Danish Application No. PA 2004 02020 filed Dec. 29, 2004 and PCT/DK2005/000835filed Dec. 29, 2005, which are hereby incorporated by reference in their entirety.

TECHNICAL FIELD

The present invention relates generally to devices for bone fracture prevention, especially for the prevention of hip fracture during impact from a fall, and related methods.

BACKGROUND ART

Hip Fracture Epidemiology

According to prior art document U.S. Pat. No. 5,599,290 fractures of the proximal femur are a major source of mortality and morbidity among the elderly. Approximately 250,000 hip fractures occur in the United States annually. Nearly 33 percent of women and more than 17 percent of men will experience a hip fracture if they live to age 90. Among patients who are functionally independent prior to a hip fracture, 15 to 25 percent remain in long-term care settings for more than a year afterward. Another 25 to 35 percent are dependent on others for their mobility. More than half of those that survive hip fracture never recover normal function. Moreover, the average mortality associated with hip fracture in elderly patients is approximately 20 percent in the first year.

The public health impact of hip fractures is also staggering. Surveys in the United Kingdom have shown that at any one time about 50 percent of acute orthopaedic beds are occupied by hip fracture patients. In the U.S., the average length of hospital stay for hip fracture patient is three weeks, longer than for any other diagnosis. The annual costs associated with the acute and chronic care of hip fracture patients in the United States is estimated to exceed $7 billion. The problem can only be expected to worsen with projected increases in the average age of the world population, leading some to suggest the possibility of a nearly three-fold rise in the total number of hip fractures by the middle of the next century.

Over 90 percent of all hip fractures are caused by falls. However, the majority of falls in the elderly result in only minor injury, with one to three percent causing hip fracture. Surveys among elderly fallers have shown the following factors increase the risk for suffering a hip fracture in a fall (in order of importance): 1) impacting on the hip or side of the leg (which increases the risk of fracture by over 20-fold), 2) having a tall, slender body habitus, 3) falling with a high initial potential energy (which depends on both body mass and the height of the fall), and finally 4) possessing low bone density in the proximal femur. These results suggest the risk for hip fracture in a fall is dominated by the severity of the fall as opposed to the density and strength of the proximal femur. To reduce the incidence of hip fractures, hip fracture prevention strategies must therefore either reduce the incidence of falls, or protect the femur in the event of a fall. The former strategy may be accomplished by restricting mobility, although this carries associated medical risks and impairs personal autonomy and quality of life. It might also be accomplished through exercise programs in the elderly populations at greatest risk for falling, although no study to date has proven the effectiveness of such an approach. In any case, it seems unrealistic to expect the complete elimination of falls among the elderly, given the often multiple factors (cardiac, neural, musculoskeletal) and random causes of falls. It therefore appears that the most reliable method for reducing hip fracture incidence is to protect the femur during the impact stage of the fall. This essentially requires lowering the impact force applied to the femur to a value below its fracture threshold.

Hip fracture refers to fracture of the proximal end of the femur, which is the strongest, heaviest, and longest bone in the body, accounting for approximately one-fourth of total body height. The proximal end of the femur consists of a head, neck, and greater and lesser trochanters. The neck of the femur connects the spherical head to the shaft. It is limited laterally by the greater trochanter, a large, somewhat rectangular lateral projection from the neck and shaft, which provides an insertion site for several muscles of the gluteus region. The greater trochanter lies laterally, just beneath a relatively thin layer of skin and adipose tissue (fat), and can be easily palpated on the lateral side of the thigh. Since it is the most lateral point of the hip region, the greater trochanter is the site which comes into contact with a hard surface when one lies on one's side, and the site where the majority of impact force is applied when one falls sideways onto the hip. Consequently, falls to the side resulting in impact to the greater trochanter carry a high risk for hip fracture.

In contrast to the minimal amount of soft tissue covering the greater trochanter, a considerable quantity of soft tissue exists in the posterior gluteal (buttock) and anterior thigh regions adjacent to the greater trochanter. Upon impact to these regions, this soft tissue is able to absorb significant energy, and lower the impact forces applied to the underlying skeletal structures. Gluteal soft tissues include the gluteus maximus, medius, and minimus muscles, as well as the considerable layer of fat overlying the buttock. The most significant anterior thigh soft tissues are the quadriceps muscles, which include the three vastus muscles and the rectus femoris muscle.

Experimentally, when the elderly cadaveric femur is loaded in a configuration simulating a fall on the hip, the average force required to fracture it is 2040N [Lotz J C and Hayes W C, J Bone Joint Surg [Am], 72-A:689-700, 1990]. The corresponding average energy absorbed by the bone up to fracture is 25 J. At standing height, the potential energy of the body can be well over 20 times this amount. Previous research suggests the force applied to the femur at impact from an average sideways fall to the hip is about 6 kN, over three times the mean fracture force (Robinovitch, S N, Hayes, W C, McMahon, T A, J Biomech Eng, 113: 366-374, 1991). It therefore appears that to avoid hip fracture during a fall, one or more of the following must occur: 1) direct impact to the lateral aspect of the hip must be avoided, 2) the impact site must extend outside the hip region, or 3) significant energy must be absorbed by alternative mechanisms such as contraction of the thigh muscles during descent, breaking the fall with an outstretched hand, or deformation of both the floor and the soft tissue overlying the impact sight.

Similar to hip fracture, fracture of other bones such as the tibia, radius, and ulna occurs when the force applied to the bone exceeds that required to initiate fracture. Often such a situation arises when the impact energy is high, and contact occurs to a small area directly overlying the fracturing bony structure. In such circumstances, the impact energy cannot be absorbed and/or dissipated through a large area, and high local stresses are applied to the underlying bone.

Prior Art Protective Devices

Several protective garments have been developed with the aim of preventing hip fractures. All of these devices attempt to reduce fracture incidence by reducing the impact force applied to the femur during a fall on the hip.

A device is proposed in U.S. Pat. No. 5,599,290 and in U.S. Pat. No. 5,545,128. This solution is based on the use of shear-thickening material which is disposed in at least one protective device which is shaped in accordance with the anatomical features of the vulnerable region and the soft tissue region. This device utilizes the shear thickening behaviour of the material and its inherent ability to stiffen with a sudden impact to shunt a substantial portion of the impact energy from the vulnerable region to the soft tissue region where such energy may be safety dissipated. Moreover, the prior art documents disclose mounting means for removable mounting the protective device on the subject in such away as to permit the shunting of impact energy from the vulnerable region to the soft tissue region.

Even though the prior art technology provides a solution overcoming the above problems there would be problems associated with such protective devices. This problem is primarily due to the use of shear-thickening material which makes the device heavy and which requires the shear-thickening material to be encased in encapsulations that are able to maintain a stable form in order for the force shunting properties to be consistent and durable in wear and washing. Moreover there is a risk of shear-thickening material leaking from the encapsulations, i.e. in or after washing, due to its fluid properties.

Prior art technology also discloses garments comprising protective devices or shells based on a shunting principle, consisting of or incorporating rigid materials, i.e. in a curved or dome shaped form. However, such rigid devices have been seen to affect wearer acceptability in a negative way and a soft protective device is more comfortable to the wearer than a hard inflexible device, i.e. when sleeping on the side.

Furthermore, soft cushion or pad type products also exists, i.e. consisting of 8-18 mm thick polymeric foam material cut to i.e. a circular or oval shape, simply overlying the entire hip region. Such energy absorbing and/or dissipating materials or structures placed directly over the greater trochanter and surrounding area (Ferber, U.S. Pat. No. 4,807,301; Galton, U.S. Pat. No. 4,737,994; Kolb, U.S. Pat. No. 4,761,834; Kolsky, U.S. Pat. No. 5,034,998; Wortberg, U.S. Pat. No. 4,573,216) have the major drawback that they cover the greater trochanter and proximal femoral diaphysis, and thus transmit considerably load to these regions during impact to the hip. As described previously, these regions of the femur, and in particular the greater trochanter, extend furthest laterally of all bony components of the hip region, and are protected by a minimum of overlying soft tissue. They thus represent the regions of lowest compliance within the total protected area, and subsequently, during impact to the protective garment, the majority of impact force is transmitted to the femur.

U.S. Pat. No. 6,195,809 discloses a generally elliptical first base portion with a raised portion superimposed thereon. The raised portion is provided in the form of an open annulus having an inverted U-form. Such a product is an improvement compared to generic foam pads in a plate format as far as force attenuation goes. However, still the greater trochanter is impacted through forces directed through the base portion material.

Such prior art soft pad devices tend to cover a large area of the hip region, including the greater trochanter region, be non-breathable and thus warm to wear, and therefore attempts have been made to increase breathability and reduce heat i.e. by providing a plurality of smaller holes on the device surface area. Other commercially available soft pad devices have a small circular hole in the pad centre (diameter approx. 2-2.5 cm), according to the manufacturers instructions to enable that the wearer or caregiver can check with a finger if the device is positioned correctly, centred around the greater trochanter.

As previously mentioned, such soft pad devices are by large energy absorbing and have the drawback that they still transmit a substantial portion of the energy directly to the greater trochanter, as they directly overlie the greater trochanter. Thus, they have to be relatively thick in order to be somewhat efficient, which makes them bulky when worn and warm to wear which again leads to lower wearer acceptability.

It is the object of the present invention to provide a solution to the above problems by providing a garment, a device and a method for reducing the risk of bone fracture which would comprise a lightweight soft and protective device which is comfortable and less warm for the wearer and which maintain a stable form and which makes it possible to shunt, absorb and retransmit a substantial part of the impact energy to the soft tissue region surrounding a vulnerable region.

SUMMARY OF THE INVENTION

According to the present invention the above disadvantages and drawbacks are overcome by providing a garment according to claim 1 or 2.

The protective device according to claim 14 will also provide a solution to the above disadvantages and drawbacks and fulfil the object of the present invention. According to the present invention also a method as defined in claim 18 will fulfil the purpose of the present invention.

The solution according to the present invention would basically make use of the possibility to shunt, absorb and retransmit impact energy which is directed against the vulnerable region to the surrounding soft tissue region in order to obtain a safely dissipation of the energy. Even though the device according to the present invention is made of soft protective materials that in themselves are mainly energy absorbing, the geometry and dimensions of the new device makes it suitable to shunt energy away from the vulnerable region and retransmit it to surrounding soft tissue. In order to obtain this effect the protective device is manufactured from cushioning elastic material in order to obtain a soft and protective device which is comfortable for the user. The device is provided in a shape and size where it partly or totally surrounds but not overlies the vulnerable region thereby only overlying the soft tissue region. Seeing that the device has a specific Shore A hardness combined with a sufficient thickness, a protective space or protective free height over the vulnerable region surrounded by the device is provided, in the following referred to as "protective space".

By providing the elastic material with sufficiently elasticity/hardness relating to the chosen thickness the device will in a fall be partly compressed by the impact force thereby absorbing a substantially part of the impact energy. As the material of the device does not directly overlie the vulnerable region where instead the protective space is provided, the device has to be compressed substantially, before any energy is transferred directly to the vulnerable region. As the elastic material compresses and thus becomes more rigid, the transferring of energy to the underlying soft tissue region increases, still not transferring any energy directly to the vulnerable region. Only in the case that the fall is so severe that the protective space "bottoms out", and/or sinks into the soft tissue, a part of the impact energy will be transmitted directly to the vulnerable region, but in such case the impact energy will be reduced to a significantly lower level.

In other words, the impact force will first due to the protective space be redirected or shunted to the surrounding protective device, it will start to compress the protective device against the action of the elasticity and hereby an attenuation of the impact force directed against the vulnerable region/the greater trochanter is obtained and the remaining impact energy will increasingly be retransmitted to the soft tissue region being covered by the part of the protective device surrounding the protective space. In this way the majority or all of the energy in a fall may be safely shunted, absorbed and/or dissipated in the soft tissue region.

The device according to the present invention could be removable mounted on a wearer. The mounting may be effected in such a way that the interior protective space coincides generally with the vulnerable region. Hereby the impact energy received by the protective device overlying the soft tissue will be totally or substantially dissipated in the soft tissue and not the vulnerable region.

Seeing that the present invention provides a device comprising material surrounding the vulnerable region and extending to a position or height above the vulnerable region at a central location of the device, a substantial part or all of the impact energy is retransmitted to the soft tissue region when a suitable combination of material stiffness/hardness and thickness is used. There would thus be no or a substantially reduced impact energy or force acting at the vulnerable region.

By providing sufficient high elasticity it is possible in embodiments of the present invention to provide the device in a lightweight form of cellular, foamed or spacer fabric materials and having a thickness small enough to be compatible with wearer acceptability and which is comfortable to use seeing that it conforms to the shape of the body during daily wearer activities such as walking, standing, lying down and sitting.

The device may in accordance with preferred embodiments of the present invention be arranged in such a way that it overlies the soft tissue region but not the vulnerable region/the greater trochanter region for receiving and shunting the impact energy from the vulnerable region, absorbing and retransmitting a substantial portion or the total of the impact energy to the soft tissue region. Mounting means could include means for mounting the device in such a way that it overlies the soft tissue but not the vulnerable region/the greater trochanter.

The mounting means may be provided in form of a pair of short pants in which the device is disposed. Normally for the device to protect the greater trochanter the pair of short pants would comprise two protective devices. According to a further embodiment the mounting means include belts comprising one or more protective devices, keeping them securely in place.

According to a further embodiment it is possible that mounting means may be provided in the form of adhesive means for adhering the protective devices to the skin of the wearer or other attaching means, i.e. hook/loop, enabling the device to be attached to i.e. a pair of shorts.

According to preferred embodiments for the present invention a hip protection device may be provided with a thickness between 10-20 mm, preferably between 12 and 17 mm. This will create the protective space with a similar height. This thickness of the material would be associated with elastic material that has a Shore A hardness between 5 and 45 as measured according to ASTM 2240-97 Standard Test for Rubber Property—Durometer Hardness.

Moreover, it is noted that a hip protection device according to the present invention would have a weight which normally would be less than 40 g and preferably less than 30 g.

Suitable materials are elastic materials based on i.e. polyurethane, polystyrene, polyolefin, polyethene, polyethylene, polypropylene, polyester, polyamide, rubber- or silicone. Moreover it is preferred that the elastic material is. in a knitted-, woven-, cell-, foam- or expanded form.

It is preferred to manufacture the device from closed cell foam which does not absorb water or spacer fabric format which is water durable and easily dryable. Thereby the device is made very hygienic and durable, without requiring encapsulation.

Such embodiments would provide sufficient protection as well as comfort for the wearer. Due to the open protective space over the vulnerable region, such embodiments will be less warm to wear than most conventional devices. In order to enhance the comfort it is also possible to provide a skin friendly layer on the skin side or inside of the device, for example of spacer fabric, double sided fabric or other textile or non-textile material. Using a double sided or spacer fabric makes it possible to create an air layer and establish continuously air circulation between the device and the skin, which is of particular importance if the device is manufactured from non-breathable materials. This could prevent an uncomfortable heat and humidity build up thereby increasing the user comfort. It is possible to increase this effect by incorporating specific high technological materials, e.g. Coolmax yarns and thermo-regulating materials, e.g. Outlast.

It is preferred that the protective space is forming an air-channel from the skin to the outer side of the protective device, allowing moist and water vapour to escape from the body, making the wearer feel less warm It is preferred that the garment and the device are manufactured in materials which could be reused and washed a substantial number of times. The device could be manufactured in a form where it is removable from or affixed to the garment and can thus either be washed with the garment or cleaned separately. Alternatively it is also possible to provide a disposable device, i.e. for Acute Care.

As it occurs from the above explanation of the inventive concept it is possible to provide the protective device with different forms. However, it is an important feature that the protective device provides a protective space in that it comprises a comparatively large opening or hole in a position to overlie the vulnerable region and it is likewise important that the protective space has a certain height above the vulnerable region/the greater trochanter.

The chosen hardness, shape, size and thickness of the device would depend of the intended use, the position of the body, which vulnerable region is to be protected, the properties and strength of the vulnerable region and the expected level of impact energy and force in a fall. The side of the device which is directed against the wearer could either be flat or having a curvature in order to adapt well to the body and provide the necessary protective space.

In case the device is intended for protecting the greater trochanter and femur, the horizontal width of the protective space overlying the greater trochanter and/or femur would be between 40 and 70 mm. The vertical length of such protective space could vary and may have approximately the same size as the width but could also extend over a longer distance towards the lower edge of the protective device e. g. by providing the product in a horseshoe form, in order to also protect the femur.

In accordance to the present invention a horseshoe form would be a form in which the arms of the horseshoe would be arranged in a position along the femur. The arms of the horseshoe could be securely maintained in their position through the use of i.e. a thin material partly or fully overlying the protective space or through the use of one or more connecting strips or other connecting means. The covering could be an integral part or could be at separate component, i. e. a fabric layer attached to the horseshoe or the garment containing device. Anyway such covering or connecting strips should be as thin as possible and in any case very thin compared to the height of the protective space in order not to reduce the protective effect of the device. E.g. the thickness might be 0-2 mm.

A thickness of 1-2 mm is used when the covering is made integral e.g. by a manufacture by moulding and in such a device the overall thickness might be 11-18 mm thereby leaving 9-17 mm of free protective space above the vulnerable region. It is noted that the measure of the height of the protective space is effected based on flat surface and not a person where the body normally will have a curvature which vary from person to person.

A further method of securing the position and distance of the arms could be to build separating means into the garment in which the device is contained, i.e. by providing one or more seams or other connections in the garment in area between the arms of the device.

The outer contour of the protective device could be oval, rectangular or round or any combinations hereof. Alternatively, a garment may be provided in a form in which the protective device consists only of two parallel arms which could be compared to the two arms of a horseshoe formed product, however, without the connecting branch between the two arms. If the garment is intended to protect the femur/greater trochanter then such two separate arms would be arranged substantially vertical along the femur. Such arms could be interconnected by means of a covering or connecting strips as explained above or affixed by the shape of the containing pocket in the garment.

The device may be used to protect the greater trochanter and femur in order to obviate fractures due to fall.

A device according to the present invention could also be used to protect any other prominent bone structures partly or totally surrounded by a soft tissue region.

It may be used by people in all ages and sizes, and it may be provided in more sizes, shapes and thicknesses for different user groups and sizes.

Even though the product according to the present invention is developed to be used for humans then it is also possible to use for animals.

Experiments in a laboratory environment have shown that a product according to the present invention would give a substantially better attenuation of the impact force directed against the vulnerable region than any prior art hip protector. Thus is has been showed that prior art products provide an attenuation of between 20-40% whereas the product according to the present invention is able to provide attenuation of between 50 and 80% or even up to 90%.

It is believed that this very high performance is due to the combination of the protective space and the surrounding elastic energy absorbing material combined with the retransmitting/shunting effect due to device geometry, as the device is compressed.

In order to manufacture the device more manufacturing technologies may be used. Thus it is possible to manufacture the product by moulding, cutting of sheet- or block material, milling, thermoforming, welding and different combinations of these technologies. Furthermore, it is also possible to manufacture the product by assembling more layers or parts by i.e. welding, gluing or lamination and such layers or parts could have different or the same properties Furthermore, it is also possible to provide the device with a rigid component, i.e. a flat or dome-shaped outer shell overlying said elastic material.

Depending on the elastic material used it may be advantageous to encapsulate the device for instance in a waterproof membrane, whereby it is possible to use materials for the device that are not washable, i.e. that absorbs water or deteriorates with multiple washings.

The surface of the device may be provided with information or patterns through i.e. printing, laser engraving or embossing.

In case the device is intended for use in a pocket in mounting means it is possible to provide the device with a covering reducing or controlling the friction when inserting the protective device into the pocket or which may ensure that the protective device does not rotate, bend or move in the pocket during wash or during wear. Hereby it is ensured that the protective device would always be correct positioned.

Such a covering material, made in i.e. textile fabric, may also be used as a mean to affix the device, i.e. by forming a textile trim along the edges of the device, that enables the device to be directly sewn or welded onto a garment, i.e. the pair of shorts, without having to form a pocket.

If the device is contained and worn in a pocket in a garment, the shape and size of the pocket can be formed in such a way that the device is kept securely in place in the garment by optimizing the pockets shape and properties in relation to device shape, i.e. making the pocket tight fitting, inelastic, asymmetric, provide it with guiding seams or other connection means, so that the device is not able to turn, bent or be mounted in a wrong way.

BRIEF DESCRIPTION OF THE DRAWINGS

The features and advantages of the present invention will be better understood by reference to the following detailed description, taken with the accompanying drawings in which:

FIG. 1 shows a perspective view of a garment 1 comprising a protective device 4 in the shape of a horseshoe. The protective device is mounted on the hip 2 of a human subject 3. The horseshoe formed protective device 4 comprises two arms 5, 6 and a branch 7 interconnecting the two arms. The protective device 4 surrounds partly a vulnerable region in the form of the greater trochanter 8 and the femur 18 which is surrounded by a softer tissue region 9 covered by the protective device 4.

Figure 1:
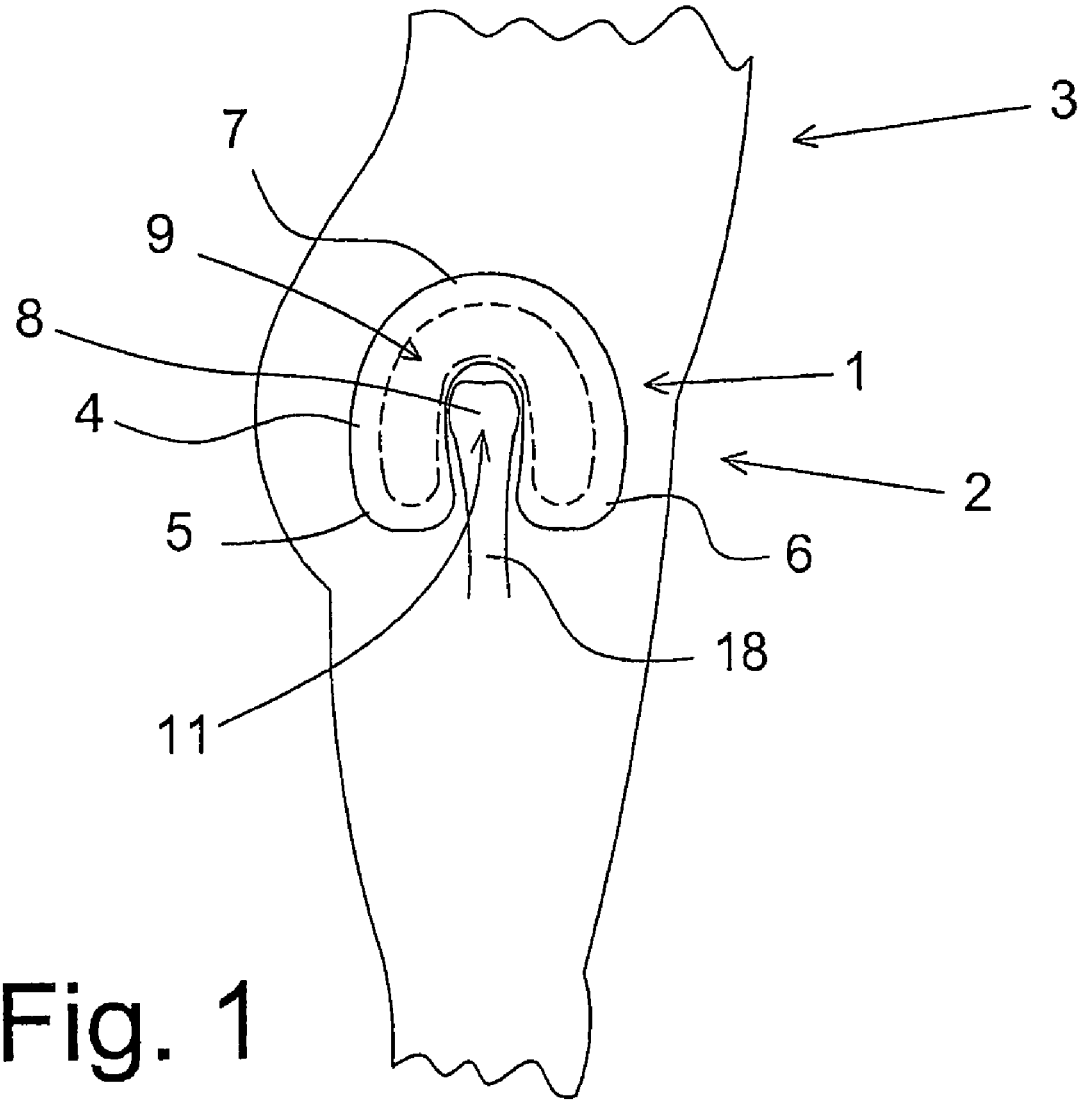
FIG. 1 is a perspective view of a protective garment in accordance with the present invention shown as worn on the hip of a human subject.

It occurs from FIG. 1 that a protective space 11 is arranged in the area overlying and proximate to the greater trochanter 8 and the femur 18.

Figure 5:
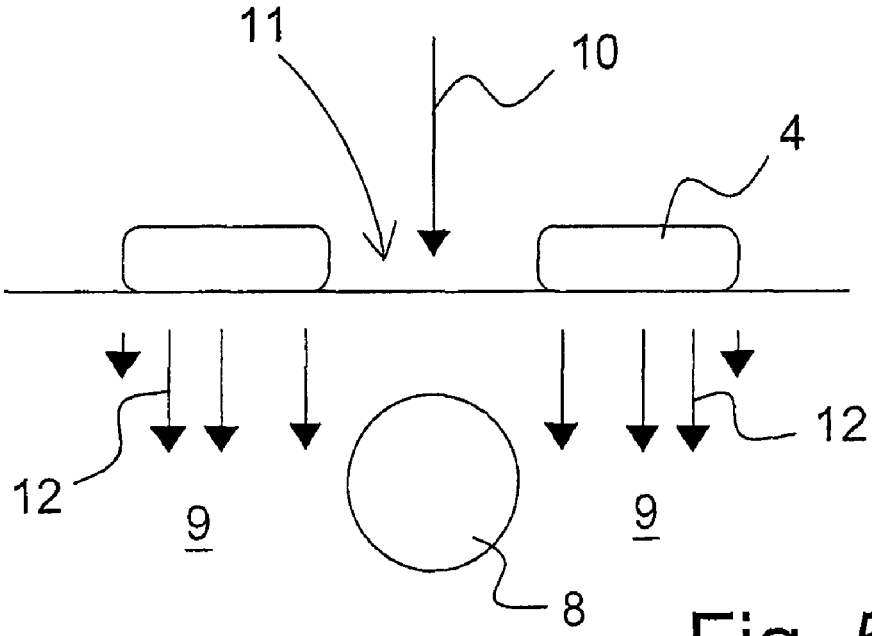
FIG. 5 is a schematic view corresponding to FIG. 4, however, illustrating the impact force in the region of the greater trochanter when using a protective device according to the present invention.

During the application of an impact force 10 associated with a fall as schematically illustrated in FIG. 5, the impact energy is partly absorbed in the elastic material of the protective device 4 and partly shunted by the protective device 4 to impact forces 12 on the soft tissue region 9, reducing the impact force on the greater trochanter and femur to none or a significantly lower value.

In accordance with an alternatively embodiment the protective device 4 might be covered by a thin layer of material covering the space between the arms 5, 6. The layer in the alternative embodiment could have a small thickness which would be added to the protective device total thickness, so that the height of the protective space 11 (as seen perpendicular to the plane of the drawing) would remain the same in order to achieve the same level of protection. Such embodiments could i.e. be manufactured from cellular polyolefin by thermo moulding.

The embodiment according to FIG. 2 comprises a protective device 4 as explained in connection with FIG. 1.

Figure 2:
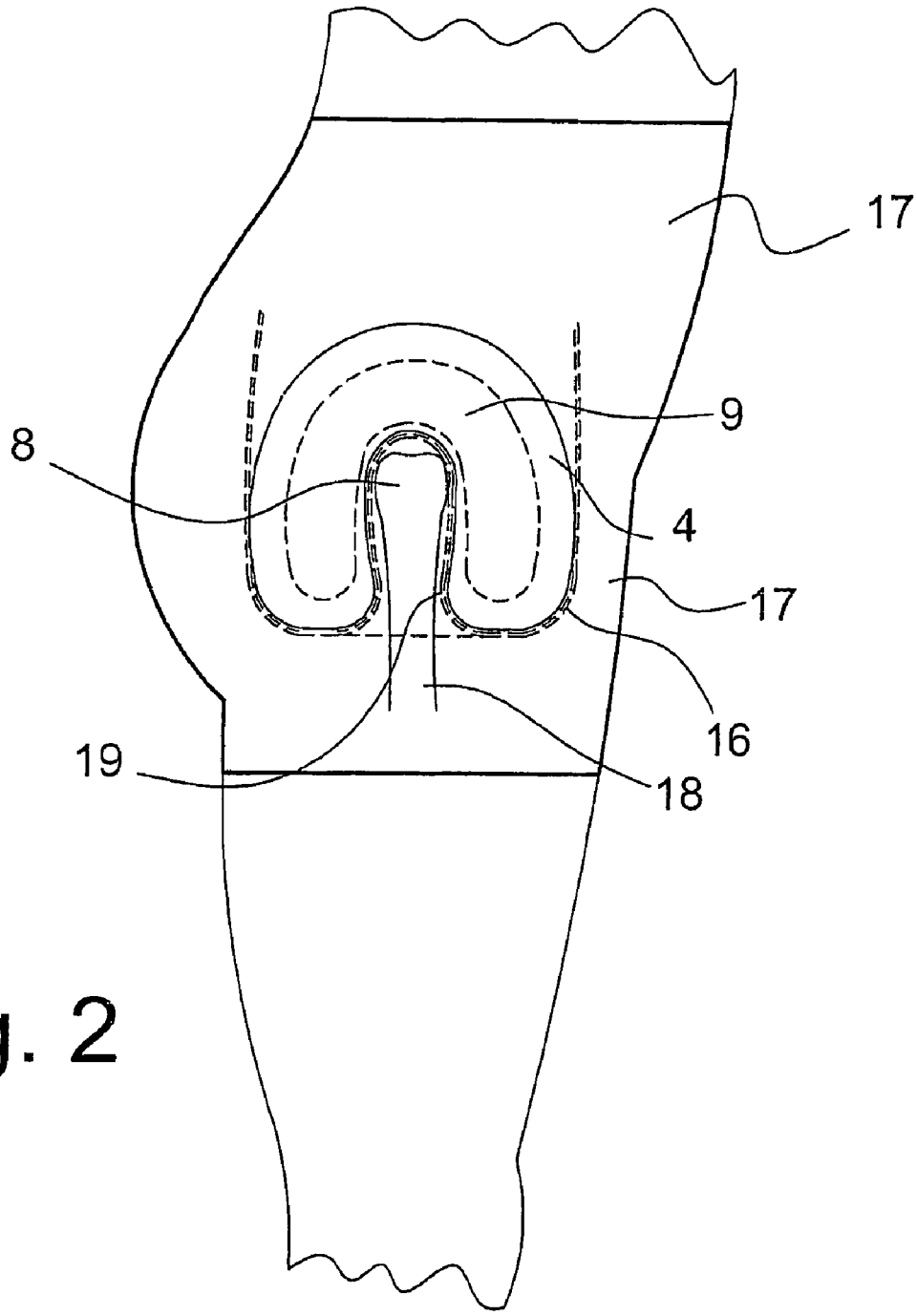
FIG. 2 is a perspective view of a protective garment in accordance with the present invention where the mounting means are in the form of a par of short pants.

FIG. 2 corresponds to FIG. 1, however, illustrates mounting means in the form of a pair of short pants 17. The pants comprise a pocket 16 having a form corresponding to the form of the protective device in order to maintain the protective device in a correct position in relation to the greater trochanter 8. A connection, i.e. a seam 19 is provided between the arms 5,6 in order to guide the protective device 4 when mounting it in the pocket 16, and thus avoid misplacement, and also to keep the protective device in correct position during wear and washing.

The embodiment according to FIG. 3 comprises a protective device 4', which is slightly different from he embodiment explained in connection with FIGS. 1 and 2.

The protective device 4' has an annular form. In stead of the "open space" between the arms of the horse shoe formed device this embodiment of the protective device has a central portion which is provided inside an annular rim portion and wherein the protective space is established. It is noted that the annular portion might have the same thickness along its round going extension or might have different thickness in some areas; e. g an area intended to overlie the femur.

Figure 3:
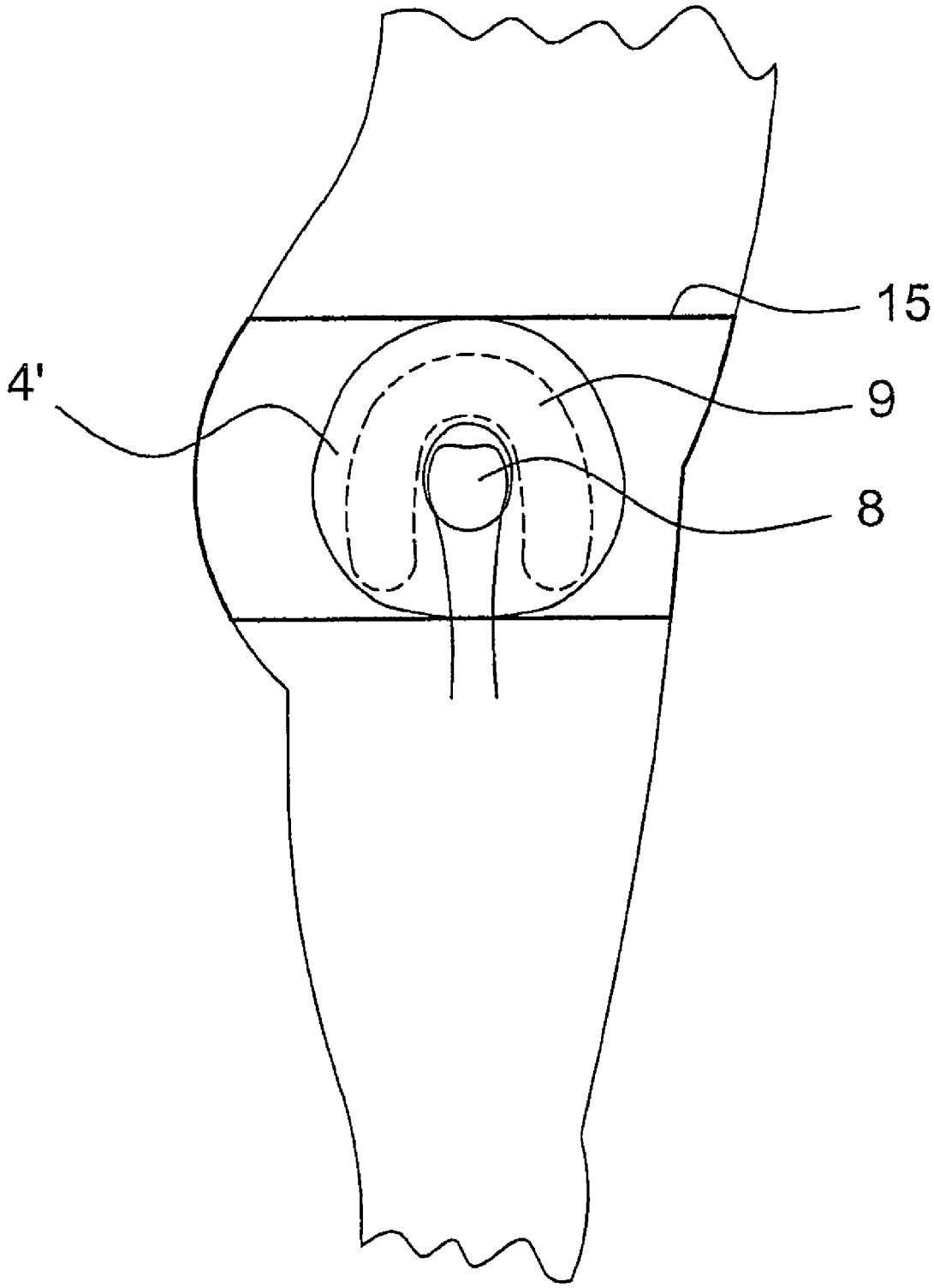
FIG. 3 is a perspective view of a protective garment in accordance with the present invention where the mounting means are in the form of a belt for attaching the device over the hip region.

FIG. 3 also illustrates different mounting means for the protective device 4'. The mounting means comprises a belt 15. The belt could be opened and closed by any suitable means, e.g. hook/loop closings (not shown).

Figure 4:
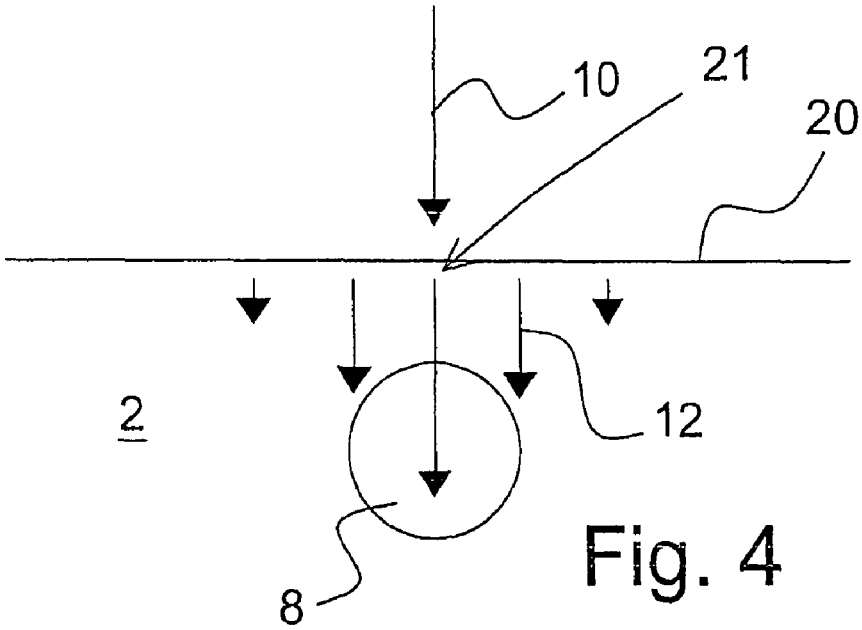
FIG. 4 is a schematic view illustrating the impact force in a fall in the region of the greater trochanter without a protective device according to the present invention.

FIG. 4 illustrates a human being 3 having a greater trochanter 8 close to the skin 20 of the human being, with only a thin layer 21 of soft tissue overlying the greater trochanter 8. An impact force 10 (schematically shown) is directed against the region of the greater trochanter 8. A number of arrows 12 illustrate that the impact energy and forces are directed against the greater trochanter and the proximate area extending around the great trochanter 8. Accordingly, the impact force would act on the greater trochanter with very little absorption of the impact energy by the overlying 21 and surrounding soft tissue 9. This would give a high risk for a fracture.

Figure 6:
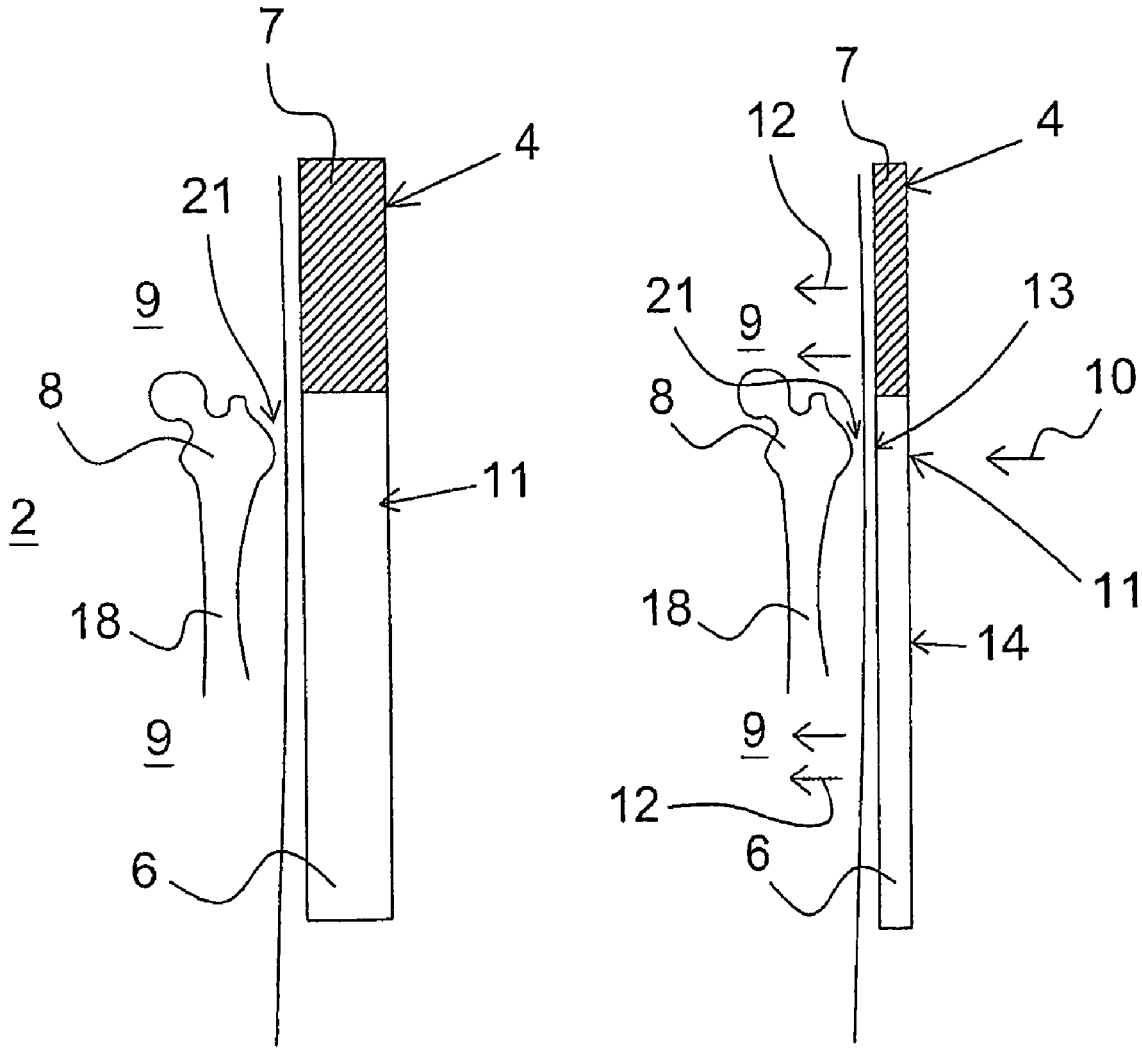
FIG. 6 is a view partly in section to illustrate the protective device before and during the application of an impact force.

As illustrated in FIG. 5 the impact force 10 (shown schematically) directed against the region of the greater trochanter 8 will due to the protective space 11, which will not transfer any energy, be shunted or directed by the protective device 4 to the soft tissue region 9. Hereby the impact energy 12 will be partly absorbed and partly retransmitted or shunted to and dissipated in the soft tissue region 9 by the elastic material of the protective device 4 which will be compressed (as illustrated in FIG. 6) and/or in part sink into the soft tissue, and thereby become more rigid, and retransmit remaining energy to the underlying soft tissue 9. In severe falls the greater trochanter region may eventually come into contact with the surface on which the fall occurs, but this will happen with a significant delay and at a significantly reduced force level.

It occurs from FIG. 6 how the protective device 4 behaves before and during the application of an impact force 10 as seen in a vertical section. Accordingly, FIG. 6 illustrates the situation for use of the embodiments according to FIGS. 1-2.

Figure 7:
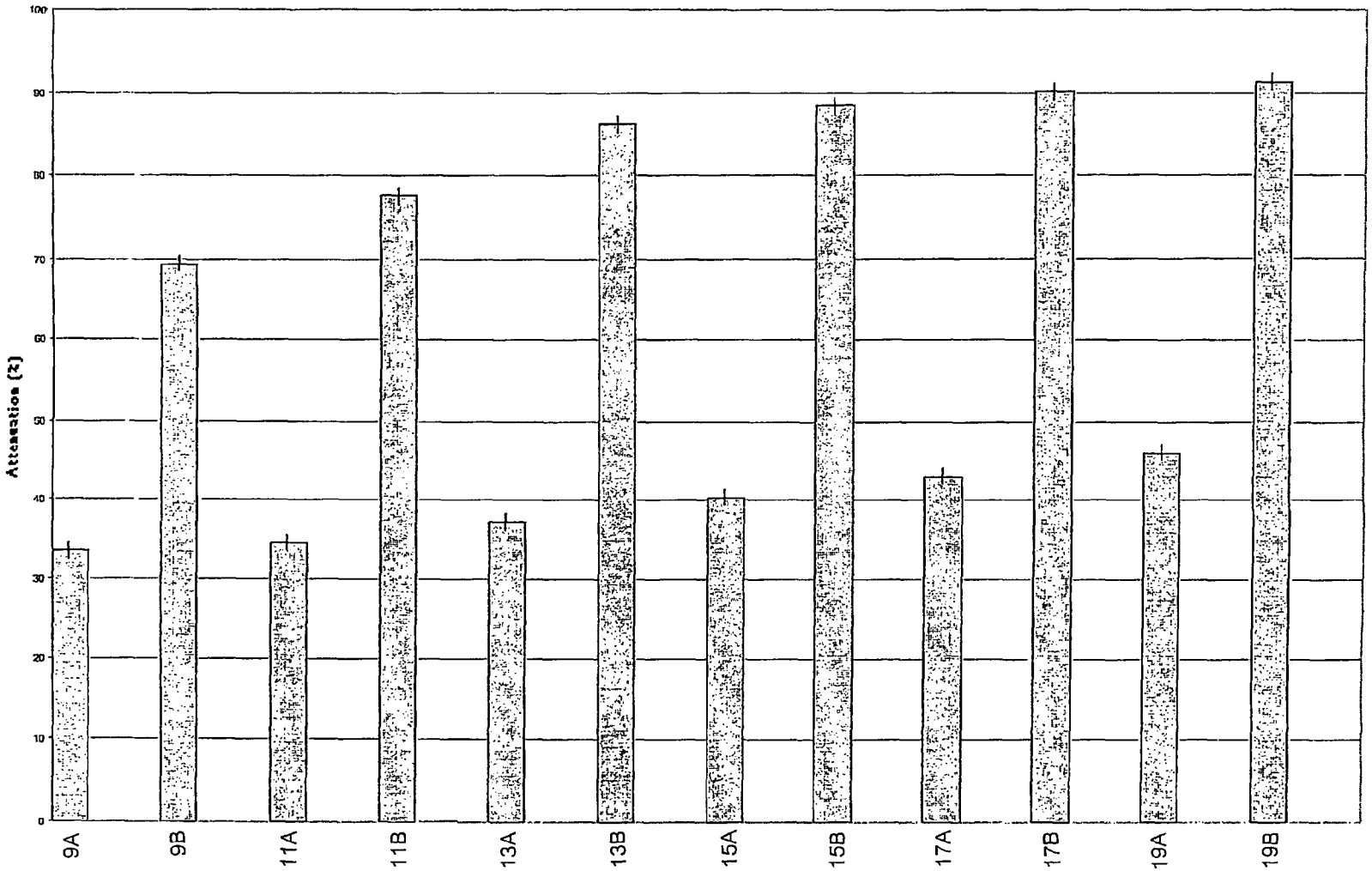
FIG. 7 shows a diaphragm illustrating force attenuation levels when using a protective device according to the present invention to prevent a hip fracture.

Laboratory tests have been conducted with protective devices according to the present invention, and FIG. 7 illustrates the achieved attenuation of the impact force on the greater trochanter stated in percent of the impact force on the greater trochanter in an unprotected fall for such protective devices manufactured from expanded polypropylene, compared with the exact same material in a solid sheet form, as seen in conventional so called soft pads.

The tests have been carried out on protective devices having identical outer dimensions and in various thicknesses from 9 to 19 mm in increments of 2 mm. To compare directly the attenuation of a solid sheet overlying the entire hip region to a horseshoe shape in accordance with the present invention, tests have been carried out without cut-out (solid plate) and with cut-out (the cut-out forms the protective space in a horseshoe) respectively shown as column A and B in the bar chart.

It appears clearly from FIG. 6 that the B-devices have a significant higher attenuation than A, as B-devices having a thickness of 11-19 mm would give 75-90% attenuation of the impact force, whereas the A-devices give an attenuation of 35-45%.

More specifically it can be seen from FIG. 6 that a sheet in 19 mm thickness gives an attenuation of 47%, whereas an 11 mm thick horse shoe device in accordance with the present invention gives an attenuation of approx. 77%.

These results clearly prove the superiority of a horseshoe shaped pad in accordance with the present invention compared to conventional soft pads. However, these test results should only be seen as indicative and resulting attenuation levels depend greatly on test configuration, i.e. on soft tissue stiffness and energy level.

The tested material has a shore A hardness of 41.5 as measured according to ASTM 2240-97 Standard Test for Rubber Property—Durometer. This is in the upper region of the acceptable elasticity/flexibility for a protective device according to the present invention, as some wearers may not consider this a soft conforming material.

According to the present invention it is preferred to use a soft material, preferably a foam material which has an elasticity/hardness measured as a shore A hardness of between 5 and 45 as measured according to ASTM 2240-97 Standard Test for Rubber Property—Durometer. It should be noted that similar tests have been carried out on material with a Shore A hardness of 9, and the results have shown that the same tendencies apply as shown in FIG. 6.

Figure 8:
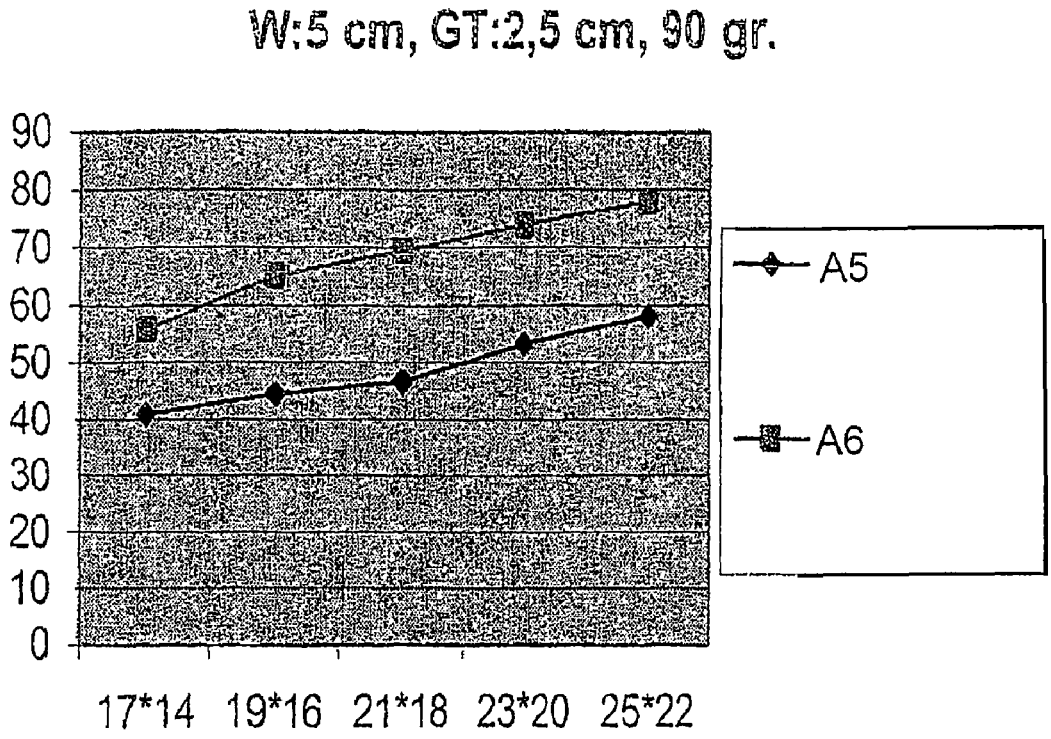
FIG. 8 illustrates two curves for attenuation varying different parameters for a protective device according to the present invention used to prevent a hip fracture.
Figure 8:
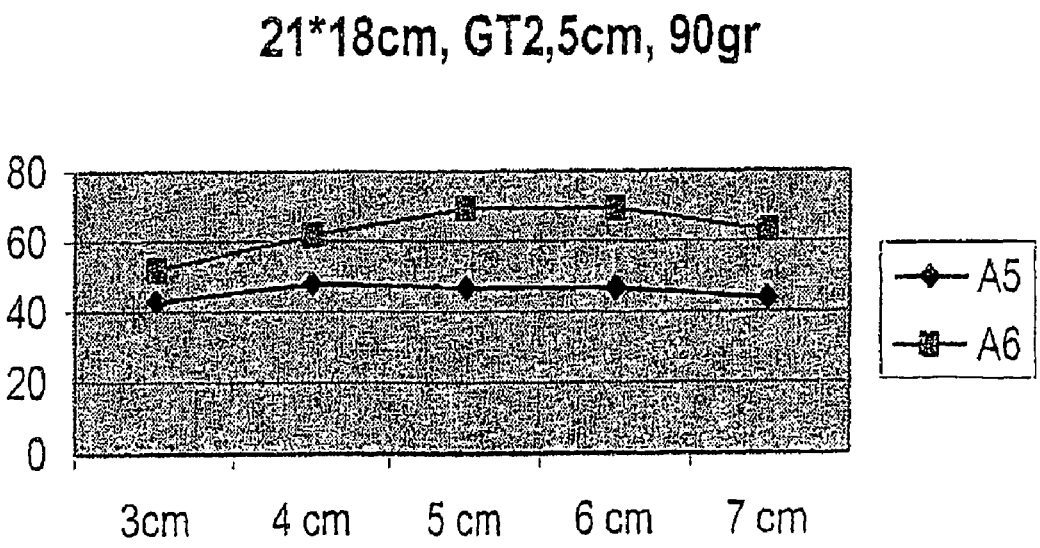

FIG. 8 illustrates 2 different curves which are relating to the table 1-2 given below.

The tables 1-2 illustrate the attenuation of the impact force in Percent of the impact force on the greater trochanter in an unprotected fall, when using different dimensions for a horseshoe formed protective device manufactured from foamed polyolefin, according to the present invention.

TABLE 1

Variable device size (L * W) with constant P.S. width 50 mm:

| | Attenuation (%): | |
|---|---|---|
| L * W | Thickness 10 mm | Thickness 15 mm |
| 17 * 14 cm | 41 | 56 |
| 19 * 16 cm | 45 | 65 |
| 21 * 18 cm | 47 | 70 |
| 23 * 20 cm | 53 | 74 |
| 25 * 22 cm | 58 | 78 |

TABLE 2

Variable width of the Protective space: (P.S.-width), with constant device size (L * W 21 * 18 cm):

| | Attenuation (%): | |
|---|---|---|
| PS width | Thickness 10 mm | Thickness 15 mm |
| 30 mm | 43 | 52 |
| 40 mm | 48 | 62 |
| 50 mm | 47 | 70 |
| 60 mm | 47 | 70 |
| 70 mm | 44 | 63 |

In Tables 1-2: P.S. is the protective space, L * W is the overall length and width of the horseshoe formed device, Thickness is the overall thickness of the tested devices, 10 mm respectively 15 mm.

In table 1 the outer dimensions of the horse shoe shaped device is varied in increments of 2 cm in both the length and the width direction, for a pad in 10 respectively 15 mm thickness. It is seen that within the tested interval, the larger the dimensions, the higher attenuation. It is also seen that the thickness has a very significant impact on the attenuation level.

In table 2 the width of the protective space which equals the distance between the arms of the horse shoe is amended from 30 to 70 mm in increments of 10 mm. It is seen that optimal distance is about 50-60 mm with the protective device positioned accurately.

A5 and A6 in FIG. 8 illustrate thicknesses of 10 mm respectively 15 mm for the protective device and thereby the protective space height.

It is seen that the protective device having a thickness of 10 mm in this case provides an attenuation of more than 40% and that the protective device having a thickness of 15 mm provides attenuation between 55% and 80%.

Figure 9:
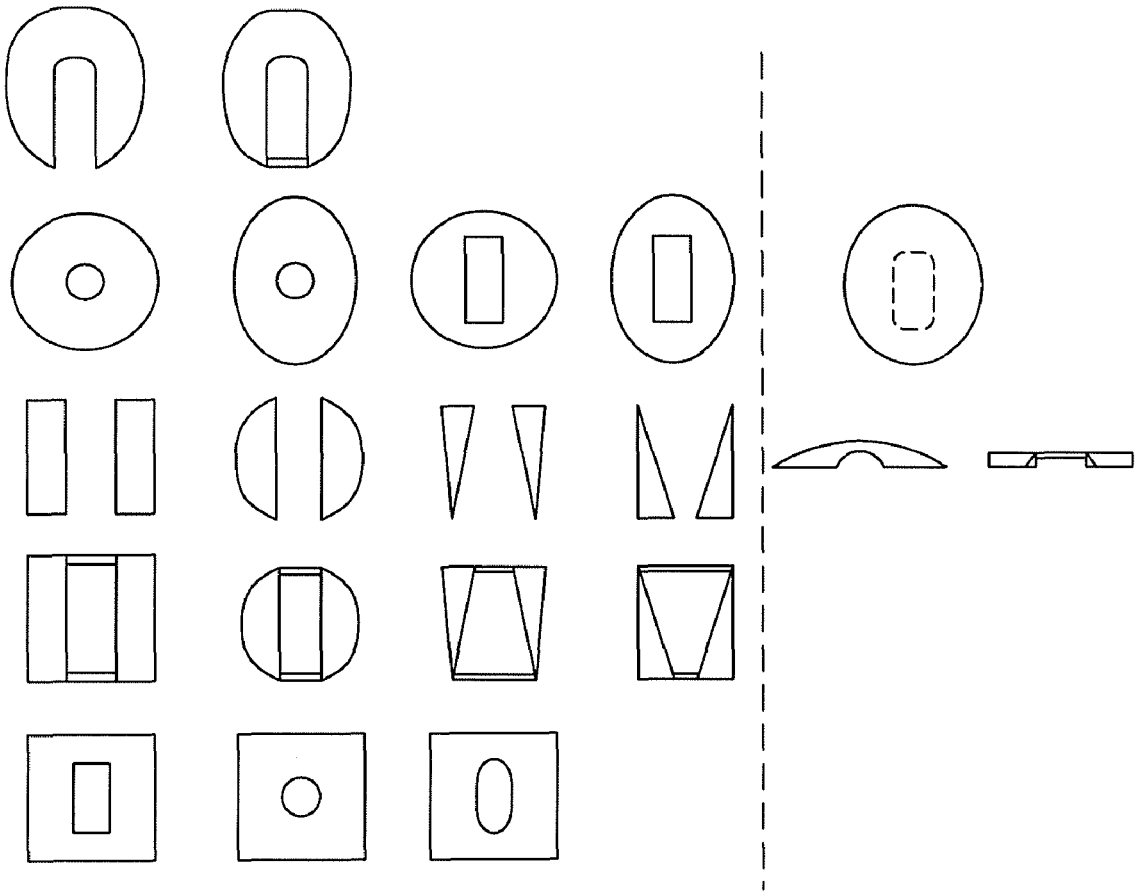
FIG. 9 is a schematic view illustrating different shapes of the protective device according to the present invention.

FIG. 9 illustrates in schematic form different possible shapes of the protective device according to the present invention. In all embodiments a protective space is defined within a central part of the protective device. Partly or totally surrounding this central part one or more peripheral parts are arranged overlying the soft tissue regions proximate to the vulnerable region which is positioned in the protective space region.

Figure 10:
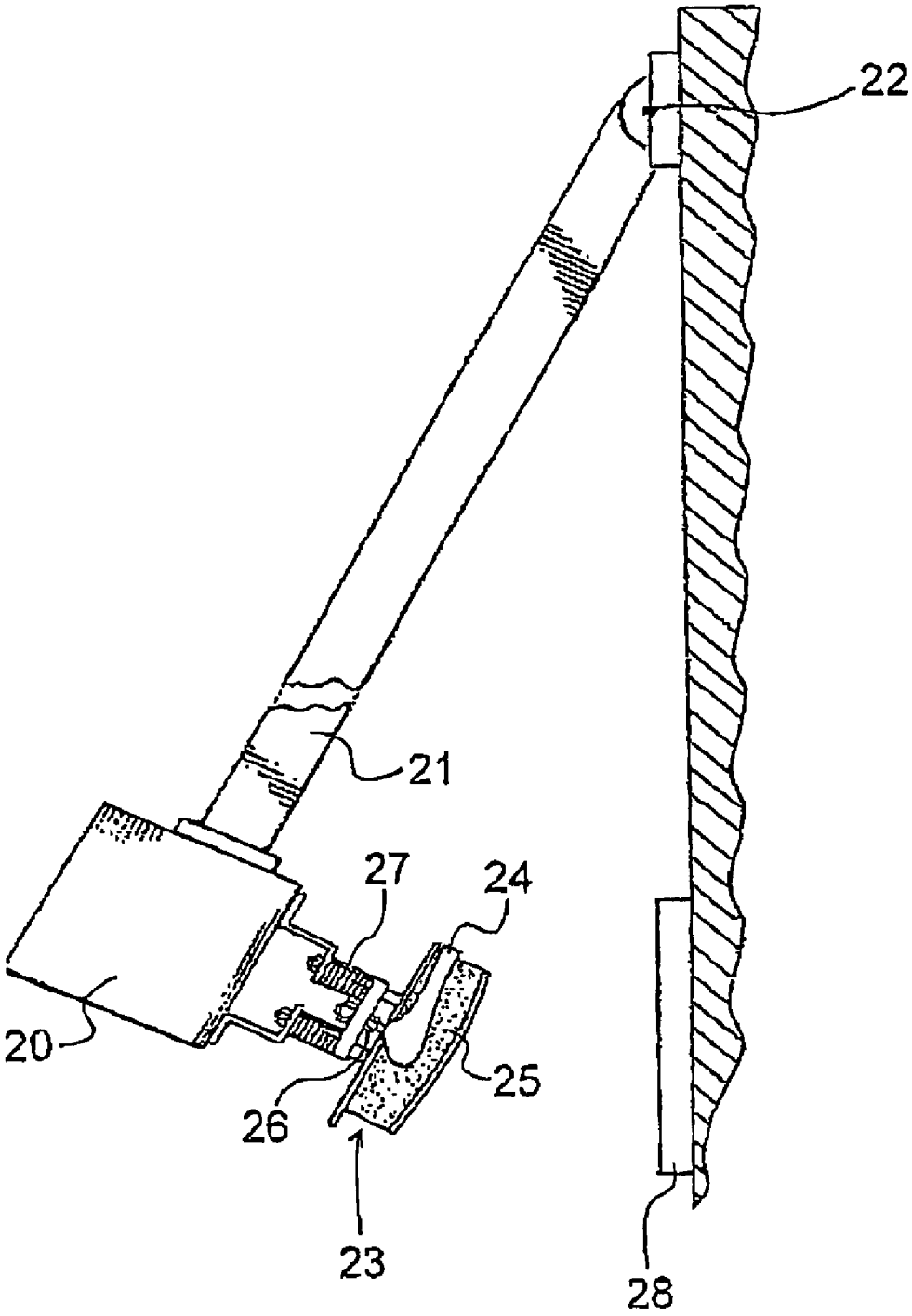
FIG. 10 is a side view of an impact pendulum and a load cell used in testing the force attenuating capabilities of the protecting device according to the present invention.

The applied force attenuation testing system is shown in FIG. 10 and includes an impact pendulum (including a mass 20, arm 21 and pivot 22) and surrogate pelvis 23 designed to match the typical female pelvis in surface anatomy and pelvic compliance. The surrogate pelvis 23 includes a surrogate femur 24 surrounded by foam 25 to simulate soft tissue. A load cell 26 producing a signal to measure force on the femur 24, and a pelvic spring 27 stimulates the effect of pelvic compliance. The surrogate pelvis allowed us to evaluate pad performance based on the combined response of the hip pad and the underlying skeletal and soft tissue structures.

Pelvic compliance was simulated by neoprene springs 27 providing the entire unit with an effective stiffness of 65 kN/m, within 13% of that measured in females undergoing simulated falls on the hip (Robinovitch, S. N., Hayes, W. C., McMahon, T. A., J Biomech Eng, 113: 366-174, 1991). In all experiments, the pendulum head was directed to impact the lateral aspect of the greater trochanter. Total externally applied force was measured by a force plate 28 on the pendulum, while the force delivered through the soft tissues to the hip was measured with the load cell 26 mounted on the femur. Pendulum impact velocity was 4.4 m/s, similar to the average hip impact velocity measured in human volunteers falling on their hip. Pendulum mass was 26 kg, matching the average effective mass of the body during impact to the hip [Robinovitch, S. N., Hayes, W. C., McMahon, T. A., J Biomech Eng, 113: 366-174, 1991]. The kinetic energy of the pendulum at the moment of impact was therefore 250 Joules.

Laboratory experiments have also been conducted with misplacement of the protective device 4 in the horseshoe shape, whereby the greater trochanter and femur are not positioned centrally and fully within the protective space area surrounded by the horse shoe device. Such experiments have shown that in spite of a misplacement of 30-50 mm up, down, sideways or a combination hereof, the horseshoe device still gives a satisfactory attenuation when compared to conventional soft and hard protectors. Accordingly the protective device according to the present invention provides a competitive attenuation compared to the prior art sheets and rigid shells even if it is slightly misplaced.

The invention claimed is:

1. A garment, for reducing the risk of bone fracture of a human or animal subject due to impact forces on a vulnerable region having a bone part near the skin surface, there being a soft tissue region proximate to the vulnerable region and lacking a bone part near the skin surface, the garment comprising:

at least one protective device shaped in accordance with anatomical features of the vulnerable region and the soft tissue region so that impact energy is at least partly shunted from the vulnerable region to the soft tissue region, where the impact energy may be safely dissipated;

mounting means for removably mounting the at least one protective device on the subject in a manner permitting the shunting of impact energy from the vulnerable region to the soft tissue region;

said protective device comprising:

one or more portions of spacer fabric, the one or more portions being shaped to partly or totally surround the vulnerable region when mounted on the skin surface of the subject, the one or more portions having a thickness ranging between 10-20 mm;

one or more open protective spaces disposed within the protective device, such when the one or more portions are mounted on the skin surface of the subject, the one or more open protective spaces are disposed above the vulnerable region to prevent contact between the protective device and the vulnerable region, wherein the one or more protective spaces have a suitable height which, in combination with the spacer fabric of the one or more arm portions, ensures said at least partly shunting of the impact energy directed against the vulnerable region to the soft tissue region as it is at least partly absorbed in the spacer fabric whereby a substantial portion of the impact energy be shunted to and dissipated in the soft tissue region.

2. A garment, for reducing the risk of bone fracture of a human or animal subject due to impact forces on a greater trochanter disposed in a hip of the human or animal subject, said greater trochanter being at the end of a femur and wherein the hip has a soft tissue region proximate to the greater trochanter and the femur and lacking a bone part near the skin surface, the garment comprising:

at least one protective device shaped, in accordance with anatomical features of the greater trochanter and the soft tissue region so that impact energy is at least partly shunted from the greater trochanter to the soft tissue region, where the impact energy may be safely dissipated; and mounting means for removably mounting the at least one protective device on the subject in a manner permitting the shunting of impact energy from the vulnerable region to the soft tissue region;

said protective device comprising:

one or more portions of spacer fabric shaped for partly or totally surrounding the greater trochanter when mounted on the skin surface of the subject, the one or more portions having a thickness ranging between 10-20 mm;

one or more open protective spaces disposed within the protective device, such when the one or more portions are mounted on the skin surface of the subject, the one or more open protective spaces are disposed above the greater trochanter to prevent contact between the protective device and the greater trochanter, wherein the one or more open protective spaces have a suitable height which, in combination with the spacer fabric of the one or more arm portions, ensures said at least partly shunting of the impact energy directed against the greater trochanter to the soft tissue region as it is at least partly absorbed in the spacer fabric whereby a substantial portion of the impact energy be shunted to and dissipated in the soft tissue region.

3. The garment according to claim 1, wherein the height of the one or more open protective spaces ranges between about 10-20 mm.

4. The garment according to claim 1, wherein the one or more portions, together with the one or more open protective spaces, provide a horseshoe shaped protective device including two arms and defining the open protective space between the two arms; and the mounting means is configured to maintain the two arms mounted proximate to opposing sides of the vulnerable region.

5. The garment according to claim 1, wherein the open protective space forms an air-channel extending from the skin to external the protective device, allowing moisture and water vapour to escape from the body, making the wearer feel less warm.

6. The garment according to claim 1, wherein the spacer fabric has a Shore A hardness between 9 and 30 as measured according to ASTM 2240-97 Standard Test for Rubber Property—Durometer Hardness.

7. The garment according to claim 1, wherein the at least one protective device has a weight less than 40 g.

8. The garment according to claim 1, wherein the spacer fabric is in a knitted or woven form.

9. The garment according to claim 1, wherein the mounting means include a pair of shorts or a belt provided with a pocket in a suitable form to maintain the protective device in the proper position.

10. The garment according to claim 1, wherein the mounting means include a belt coupled to the at least one protective device.

11. The garment according to claim 1, wherein the mounting means include adherent means for adhering at least one protective device to the body of the subject or i.e. hook/loop closures for adhering at least one protective device to a garment.

12. A protective device for at least partly shunting impact energy of a fall from a vulnerable region to a soft tissue region proximate to the vulnerable region, where the impact energy may be safely dissipated, comprising:

one or more portions formed of a spacer fabric, the one or more portions shaped for partly or totally surrounding the vulnerable region when mounted on a skin surface of the subject, the one or more portions having a thickness ranging between 10-20 mm;

one or more open protective spaces disposed within the protective device, such when the one or more portions are mounted on the skin surface of the subject, the one or more open protective spaces are disposed above the vulnerable region to prevent contact between the protective device and the vulnerable region, wherein the one or more open protective spaces have a suitable height which, in combination with the spacer fabric of the one or more arm portions, ensures said at least partly shunting of the impact energy directed against the greater trochanter to the soft tissue region as it is at least partly absorbed in the spacer fabric whereby a substantial portion of the impact energy be shunted to and dissipated in the soft tissue region.

13. The protective device of claim 12, wherein the one or more portions form a horseshoe shape including two arms with one or more open protective spaces disposed therebetween.

14. The protective device according to claim 12, wherein the spacer fabric has a Shore A hardness between 9 and 30 as measured according to ASTM 2240-97 Standard Test for Rubber Property—Durometer Hardness.

15. The protective device according to claim 12, further comprising adhesive means for adhering the protective device to the subject or to a garment.

16. A method of reducing the risk of bone fracture of a human or animal subject due to impact forces on a vulnerable region having a bone part disposed near the skin surface, there being a soft tissue region proximate to the vulnerable region and lacking a bone part near the skin surface, the method comprising:

mounting the garment according to claim 1 or the protective device according to claim 12 on the skin surface of the subject so that the one or more portions partly or totally surround the vulnerable region and the one or more open protective spaces are disposed above the vulnerable region to thereby prevent contact between the protective device and the vulnerable region, whereby the impact force compresses the one or more portions against the soft tissue region only to a degree that a substantial portion of the impact energy is absorbed and retransmitted to the soft tissue region by the compressed portions, and whereby the impact energy is safely dissipated.

17. The garment according to claim 4, wherein the two arms are maintained in the proper position by a connecting seam provided in the mounting means so as to extend inside the open protective space between the two arms.

18. The garment according to claim 3, wherein the height of the one or more open protective spaces is about the same as the thickness of the one or more portions.

19. The garment according to claim 7, wherein the at least one protective device has a weight less than 30 g.

20. The protective device of claim 12, wherein the one or more portions comprise at least two arms with one or more open protective spaces disposed therebetween.

* * * * *